US007353948B1

(12) United States Patent
McDonald

(10) Patent No.: US 7,353,948 B1
(45) Date of Patent: Apr. 8, 2008

(54) THERMOFORMED BLISTER PACKAGE APPARATUS AND METHOD

(76) Inventor: Todd L. McDonald, 205 Concord Dr., DeKalb, IL (US) 60115

( * ) Notice: Subject to any disclaimer, the term of this patent is extended or adjusted under 35 U.S.C. 154(b) by 419 days.

(21) Appl. No.: 10/941,395

(22) Filed: Sep. 15, 2004

(51) Int. Cl.
*B65D 73/00* (2006.01)

(52) U.S. Cl. ..... 206/471; 206/461

(58) Field of Classification Search ..... 206/461, 206/462, 471, 467, 470, 764, 765
See application file for complete search history.

(56) References Cited

U.S. PATENT DOCUMENTS

| | | | | |
|---|---|---|---|---|
| 4,415,084 | A | 11/1983 | Hauser | |
| D277,731 | S | 2/1985 | Sharp | |
| 4,499,353 | A * | 2/1985 | Shields | 206/470 |
| 4,669,610 | A * | 6/1987 | Lindsey et al. | 206/320 |
| 4,749,082 | A * | 6/1988 | Gardiner et al. | 206/349 |
| 4,899,877 | A * | 2/1990 | Kiernan | 206/349 |
| 5,209,354 | A * | 5/1993 | Thornhill et al. | 206/469 |
| 5,875,893 | A * | 3/1999 | Lee et al. | 206/463 |
| 5,890,594 | A * | 4/1999 | Hansen et al. | 206/472 |
| 6,053,321 | A * | 4/2000 | Kayser | 206/470 |
| 6,330,945 | B1 | 12/2001 | Reimer | |
| 6,484,875 | B1 * | 11/2002 | Brainerd et al. | 206/232 |
| 6,523,689 | B2 | 2/2003 | Mickel | |
| 6,719,139 | B1 * | 4/2004 | Foos et al. | 206/462 |
| 6,726,111 | B2 | 4/2004 | Hansen | |
| 2005/0098467 | A1 * | 5/2005 | Agakanian | 206/471 |
| 2005/0133398 | A1 * | 6/2005 | Schwester | 206/461 |

* cited by examiner

*Primary Examiner*—David T. Fidei
(74) *Attorney, Agent, or Firm*—Golden's M & I; James B. Golden

(57) ABSTRACT

A thermoformed blister adapted for use with a card member for displaying articles having a protrusion. The blister locates the card member on the blister for heat sealing using the protrusion. The protrusion provides stability and nestability between thermoformed blisters. The principle use is for point of sale displays, however other applications will benefit from this invention. For example, shipment of merchandise and storage applications will benefit from this application.

16 Claims, 1 Drawing Sheet

THERMOFORMED BLISTER PACKAGE APPARATUS AND METHOD

TECHNICAL FIELD

This invention relates generally to a thermoformed blister and more particularly to a card wall intersecting a flange that locates a card member on the card wall for displaying an article or articles.

BACKGROUND ART

Many sales displays rely on packaging to provide additional appeal of the article to the consumer. Retail stores may require many options for displaying articles for sale. Product packages have been developed that permit the article or articles to stand on retail shelves, be hung from a peg hook, and/or be part of a cut case display. The most common packages that have been developed that allow articles to be free standing with the ability to hang from a peg hook include bi-fold and tri-fold clamshell package designs as well as clamshell and "mock" clamshell packages with a foot. Utilizing these package designs is costly, requires more volume space per package, less stable, and provides a less eye appealing product. Another concept for packaging has been the "try me" type of package. This type of packaging has the desired article accessible to the consumer. These designs typically have a portion of the thermoformed plastic cut so that a portion of the article is hanging out of the package, such as, the handles of pliers. Various package designs have been developed in an attempt to improve product stability when displayed on a shelf. One such design, the bi-fold/tri-fold product package is used to provide an increased base and thus improve the stability of the product being displayed. Generally, this type of package is costly since it requires a thermoformed clamshell to form the base as well as surround the product. In addition, the volume this package design requires is typically more than what the retailer would like to have for displaying articles. Even though bi-fold/tri-fold designs may provide stability for products to be free standing, the design causes fewer articles to be displayed on a hanging display or in a cut case display. Generally, bi-fold/tri-fold clamshell package designs come with an additional cost to retailers since space per product for shipping is typically higher than similar packaged designs, such as blister packages.

In another attempt to improve point of sale packaging of articles, blister packages have been developed. Typically, a product is placed in a package that has a plastic covering that is heated which generally takes the shape of the article and requires the package to have an outer flange for sealing a card to the back of the blister. Sealing the card and blister secures the article in the package. Blister package designs generally permit a desirable number of products to be displayed from a hanging display. However, prior blister package designs do not permit the product to be easily displayed on a shelf or in a cut case. Generally the physical structure of the article, as well as the flange, causes the product to be less stable than desired for free standing on a shelf. At a minimum, blister package designs require an additional insert tray for standing displays be it on a shelf or in a cut case. The use of an additional insert tray adds to the cost of the packaging and increases the volume space necessary to display the product in standing displays. In addition, it has been found that consumers find past blister package designs to be less appealing compared with other type of package designs and in some cases find it difficult to remove the article from the package.

Another attempt to improve point of sale packaging of articles has been the "mock" clamshell package design. This design uses a thermoformed display package similar to typical clamshell designs. However, "mock" clamshell designs are unlike the blister package design in that it seals inside a platform area instead of the outside flange to seal a card to the thermoformed plastic for securing the article or articles in the package. The "mock" clamshell typically uses half the plastic as compared to clamshell designs. In addition, a forward protruding foot may be formed to provide packages that may be displayed in either a hanging or standing configuration. The forward protruding foot is limited by the article's shape and weight. Generally, having a forward protruding foot with an outer flange translates to having a product package that is typically leaning forward. In some situations, the article may be less stable than desired when placed in standing displays. Depending on the article or articles characteristics, the protruding foot may be designed for standing displays, such that, the dimension of the protruding foot would negatively impact the space the package may require in hanging, standing, or cut case displays. In addition, having a product package that is leaning forward generally reduces the eye appeal of the product to the consumer. Attempts have been made to minimize the outer flange relative to the protruding foot to minimize forward leaning of the package. Having a package design with an uneven outer flange generally provides a package that is less secure since there would typically be an opening where the seal area has been minimized.

Other attempts have been made to improve the "try me" type of package designs. Utilizing this package type with past designs requires the thermoformed package to be cut to accesses the article or articles being displayed. Generally, the process to cut the package is costly and the act of cutting the plastic may leave sharp edges about the thermoformed package that may require additional attention adding to an increase in labor costs.

The present invention is directed at overcoming one or more of the problems set forth above.

DISCLOSURE OF THE INVENTION

In one aspect of the present invention, a thermoformed blister for use with a card member includes a bottom wall that defines a plane and a top wall. A pair of side walls each defined by a bottom portion and a top portion. The pair of side walls defines a flange plane. A card wall defines a card plane. The card plane generally intersects the flange plane. A protrusion is generally hollow and extends outwardly from the card wall. A product compartment extends outwardly from the card wall and has a predetermined depth.

In another aspect of the present invention, a method of heat sealing a blister to a card member that has a card wall, a pair of side walls, a top wall, a protrusion, and an article. The method comprises the steps of loading the article into the blister. Locate the card member on the card wall using the pair of side walls, the top wall, and the protrusion. Seal the card member with the card wall.

BEST MODE FOR CARRYING OUT THE INVENTION

Figure 2:
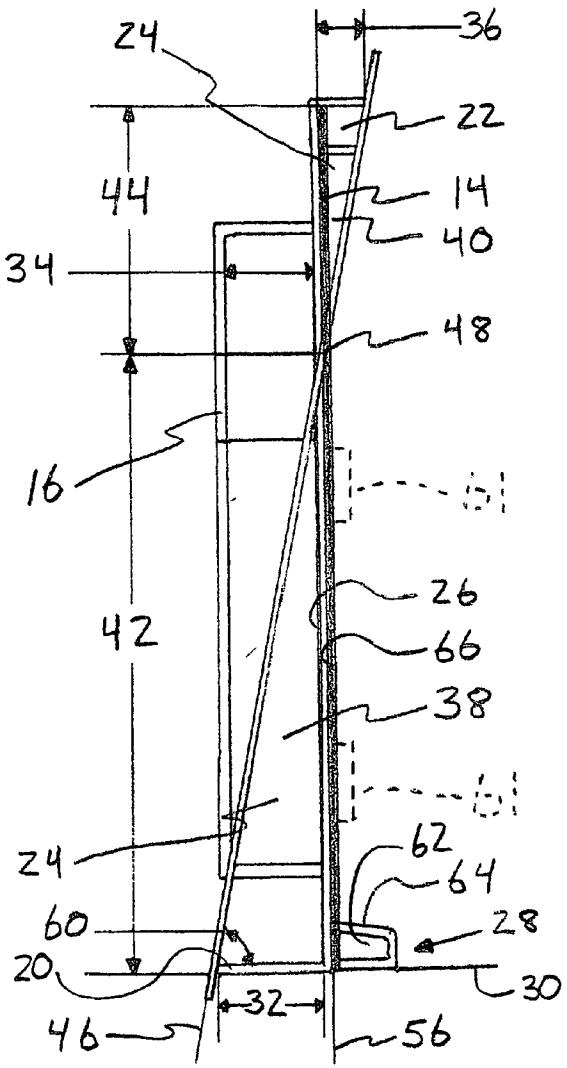
FIG. 2 is a diagrammatic side view of a thermoformed blister package embodying the present invention.
Figure 1:
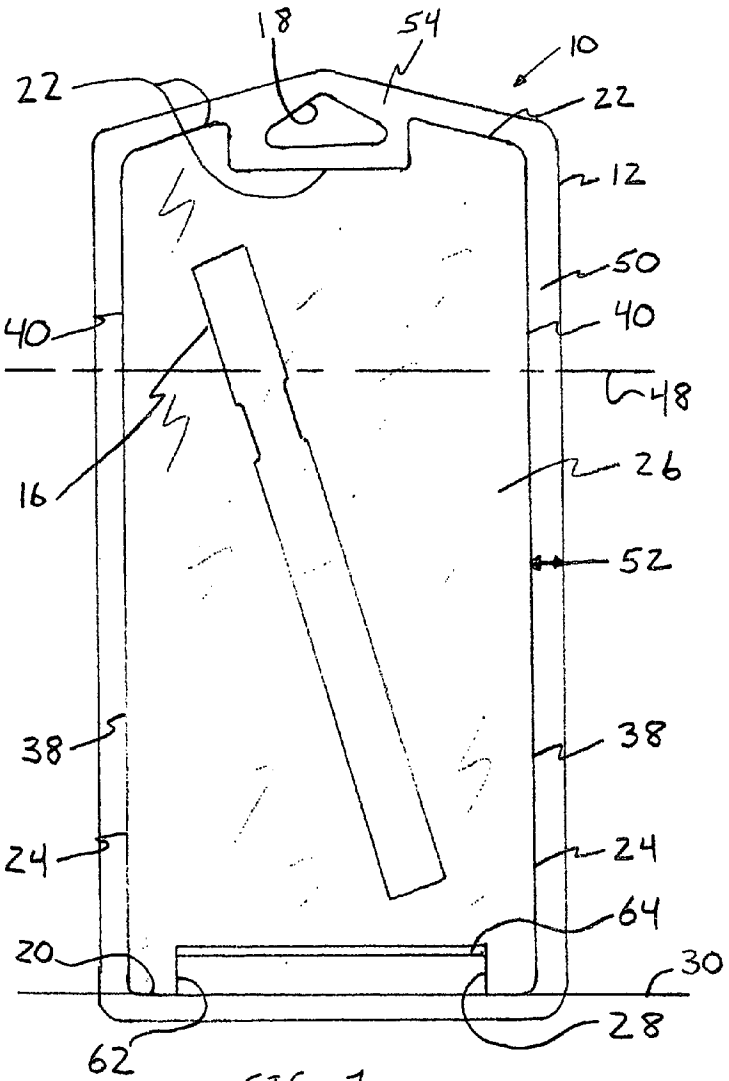
FIG. 1 is a diagrammatic front view of a thermoformed blister package embodying the present invention.

Turning to the drawings and particularly to FIG. 1 and FIG. 2 a diagrammatic view of a thermoformed blister package (10) is shown with one embodiment of the present invention. As seen therein, the thermoformed blister package (10) includes a blister (12) and a card member (14). The blister (12) includes a product compartment (16) which is shown to illustrate one of a multitude of shapes capable of receiving different articles. For illustration purposes, the product compartment (16) is shaped to receive an article, such as, a pen. However, the product compartment (16) may be shaped in virtually any desired size and shape to define an appropriate product compartment (16) for containing the article or articles to be packaged. Furthermore, the product compartment (16) may be shaped as a singular product compartment (16) to receive the desired articles or the product compartment (16) may be shaped with multiple product compartments (16) to receive the desired articles. In instances where "try me" features are desired, the product compartment (16) may be situated such that the product compartment (16) extends through a bottom wall (20) and/or a bottom portion (38). Extending the product compartment (16) through the bottom wall (20) adapts the blister (12) to have the "try me" feature without the need to cut the finished blister (12). The "try me" feature of the instant application has the article or articles disposed in the product compartment (16), such that, the article or articles extend through the bottom wall (20) allowing consumers to try the article or articles in the secured thermoformed blister package (10). Typically, an opening (18) is cut in the blister (12) to aid in hanging the thermoformed blister package (10) at the point of sale. As shown in FIG. 1, the opening (18) is inclined to better position the thermoformed blister package (10) centrally on a hook. However, one skilled in the art would recognize that other configurations maybe used without departing from the spirit of the invention. For example, a circular, rectangular, notched, multiple opening, and the like that are well known in the art maybe used. The blister (12) is preferably formed from a thin sheet of thermoplastic material in a roll feed or sheet thermoforming process. The blister (12) may be formed of PVC, RPET, PET, HIPS, high density polyethylene, polyurethane, or other suitable plastic material.

The blister (12) as shown in FIG. 1 and FIG. 2 has the bottom wall (20), a top wall (22), a pair of side walls (24), a card wall (26), a protrusion (28), and the product compartment (16). The bottom wall (20) and the protrusion (28) generally provide a stable thermoformed blister package (10) for displaying in an upright configuration. The bottom wall (20) defines a plane (30) which is used for determining distances which will be discussed later in detail. The bottom wall (20) has a first predetermined width (32) measured from the card wall (26). The first predetermined width (32) is characteristic of the article or articles being packaged. The first predetermined width (32) is generally equal to a predetermined depth (34) of the product compartment (16). Providing the blister (12) with the proportional bottom wall (20) and product compartment (16) enhances the attractiveness of the overall thermoformed blister package (10) to the consumer. However, less proportional blisters (12) may be used without departing from the spirit of the invention. For example, the bottom wall (20) with a first predetermined width (32) being a fraction of the predetermined depth (34) of the product compartment (16) or vice versa may be used to package the article or articles. The top wall (22) of the blister (12) is generally opposite from the bottom wall (20) and has a second predetermined width (36). The second predetermined width (36) is generally less in magnitude than the first predetermined width (32) of the bottom wall (20). The difference between the first and second predetermined widths (32, 36) provides a more eye catching thermoformed blister package (10) for the consumer and typically presents the article or articles in three dimensions. However, application where the first and second predetermined widths (32, 36) are equal or the second predetermined width (36) is greater than the first predetermined width (32) may be used without departing from the spirit of the invention.

The pair of side walls (24), as shown in FIG. 2, each has the bottom portion (38) and a top portion (40). The bottom portion (38) has a first predetermined height (42) measured from the plane (30) defined by the bottom wall (20). The bottom portion (38) generally decreases in width from a magnitude generally equal to the first predetermined width (32) measured at the bottom wall (20) as you reach the first predetermined height (42). The bottom portion (38) of the pair of side walls (24) aid the consumer in lifting the thermoformed blister package (10) from the appropriate display, i.e. hanging, standing, cut case, and the like. In addition, the bottom portion (38) provides protection for the article or articles being displayed by forming a protective barrier between other displayed thermoformed blister packages (10). The top portion (40) has a second predetermined height (44) measured from the top wall (22). The second predetermined height (44) is generally less in magnitude when compared with the first predetermined height (42) of the bottom portion (38). As previously discussed, applications where the first and second predetermined heights (42, 44) are equal or even when the second predetermined height (44) is greater than the first predetermined height (42) may be used without departing from the spirit of the invention. The pair of side walls (24) defines a flange plane (46). The flange plane (46) generally intersects the card wall (26) and the bottom wall (20). Generally, the flange plane (46) is in an inclined orientation with the bottom wall (20) and forms an intersection edge (48) along the bottom and top portions (38, 40) of the pair of side walls (24). A flange (50) is disposed about the pair of side walls (24), the top wall (22), and the bottom wall (20). The flange (50) has a predetermined flange width (52) that is typically uniform in magnitude. However, having blisters (12) with non-uniform predetermined flange widths (52) does not depart from the spirit of the invention. For example, as shown in FIG. 1, some applications may have a hanger portion (54) being apart of the flange (50). The hanger portion (54) has the opening (18) disposed there through for receiving a hook and the like for hanging the thermoformed blister package (10).

The card wall, as shown in FIG. 1 and FIG. 2, defines a card plane (56). The card plane (56) generally intersects the flange plane (46). The intersection of the card and flange planes (56, 46) is characteristic of the article or articles being packaged and may be optimized for greater standing stability of the thermoformed blister package (10). The intersection of the card and flange planes (56, 46) forms the intersection edge (48) along the card wall (26). The position of the intersection edge (48) relative to the card wall (26) may be position based on characteristics of the article or articles being packaged, such as, center of gravity, size, shape, and the like. For example, articles with a low center of gravity may have the intersection edge (48) closer to the bottom wall (20) than the top wall (22). Furthermore, based on the articles being packaged, the predetermined depth (34)

of the product compartment (16) may be at a magnitude where the inclination of the flange plane (46) is adjusted to accommodate varying sized articles. For example, as shown in FIG. 2, the intersection edge (48) is generally equal to the first predetermined height (42) of the bottom portion (38) and the flange plane (46) has a corresponding predetermined angle (60). In applications where it is desirable to maintain the position of the intersection edge (48) along with articles that require a greater predetermined depth (34) would typically correspond to the flange plane (46) with the predetermined angle (60) being less in magnitude to maintain the intersection edge (48) at the same position on the card wall (26). In other applications, the intersection edge (48) may be position at the top wall (22) and thus minimize the top portion (40) and may eliminate the top wall (22). In these applications the top portion (40) and top wall (22) are generally replaced with at least one locating protrusion (61). The card plane (56) is generally perpendicular with the bottom wall (20). However, one should recognize that applications may have the card plane (56) in sloped orientation with the bottom wall (20) without departing from the spirit of the invention.

The protrusion (28), as shown in FIG. 2 extends outwardly from the card wall (26) and is generally hollow. The protrusion (28) is used to stabilize the thermoformed blister package (10) when articles are in standing displays. The protrusion (28) being generally hollow enhances the ability for the blister (12) to be easily nested during the manufacturing process by allowing the protrusion (28) of one blister (12) to nest within the protrusion (28) of another blister (12). This nestability enhances the feeding of blisters (12) in the packaging process since a stack of blisters (12) maintain a general vertical configurations as well as provides for a larger quantity to be stacked in the same footprint. Furthermore, the nestability is achieved after the article or articles are secured in the thermoformed blister package (10). The nestability of the thermoformed blister package (10) allows for a more compact shipping arrangement. In addition, the nestability permits the articles being displayed to nest within each other while being hung from a hook and thus display more articles at a given time. The protrusion (28) in the preferred embodiment has an outer wall (62) and a second top wall (64). Typically, the outer wall (62) is generally circular. However, it should be recognized that other shaped outer walls (62), such as, square, oval, rectangular, curved, and the like may be used without departing from the spirit of the invention. As shown in the drawings, the protrusion (28) is centrally located on the card wall (26) adjacent to the bottom wall (20). One should recognize that protrusions (28) that may be offset would not depart from the spirit of the invention. For example, multiple protrusions (not shown) may be located on the corners of the card wall (26). In addition, the second top wall (64) may be generally inclined between the card wall (26) and the outerwall (62) of the protrusion (28) without departing from the spirit of the invention. The protrusion (28) generally extends outwardly from the card wall (26) opposite from the product compartment (16). The outwardly extending protrusion (28) locates the card member (14) on the card wall (26), such that, the card member (14) may be heat sealed to the card wall (26) to secure the article or articles in the product compartment (16). For example, in one step of the manufacturing process the blister (12) may be placed into a nesting tray of a packaging machine. The desired article or articles are inserted into the product compartment (16) followed by sealing the card member (14) to the blister (12). The card member (14) is positioned about the card wall (26) using the protrusion (28), each top portion (40) of the pair of side walls (24), and the top wall (22). In applications where the top portion (40) and top wall (22) have been minimized or eliminated then the at least one locating protrusions (61) are used along with the protrusion (28) to locate the card member (14). For example, applications may use at least one locating protrusions (61) between the top & bottom walls (22, 20) to aid in locating the card member (14). The blister (12) locates the card member (14) on the card wall (26) for the heat seal process. The card wall (26) generally has a geometric shape for engaging the card member (14), such as, rectangular, square, oval, and the like. However, any size and shape of card wall (26) would not depart from the spirit of the invention. For example, the card wall (26) may utilize an "S" or similar configurations without departing from the spirit of the invention. The size and shape of the card wall (26) may be variable as long as the blister (12) has the necessary protrusion (28), top portion (40), top wall (22), and/or at least one locating protrusion (61) for locating the card member (14) with the card wall (26). The card member (14) generally has an adhesive on one side (66) of the card member (14). The heat sealing process applies heat to the card member (14) to activate the adhesion characteristics of the card member (14) and thus secure the card member (14) to the card wall (26).

INDUSTRIAL APPLICABILITY

With reference to the Figs. and in operation, manufacturing, stability, nestability, and eye-catching appearance are enhanced by using the thermoformed blister package (10). In one embodiment, the thermoformed blister package (10) is formed by heat sealing the blister (12) to the card member (14). The blister (12) is placed in the nesting tray for automating the packaging process. In automated packaging systems, magazines are used to maintain desired supply of blisters (12). The magazines are capable of holding more blisters (12) due to the nestability between blisters (12). With the blister (12) positioned in the nesting tray, the article or articles are placed into the product compartment (16). This step is typically accomplished using human labor to place the articles into the product compartment (16) or this step may rely on an automated system for inserting the desired articles into the product compartment (16) without departing from the spirit of the invention. The next step is positioning the card member (14) on the card wall (26). Utilizing the blister (12) of the instant application locates the card member (14) without the use of external locating pins. The intersection of the card plane (56) and the flange plane (46) provide the pair of side walls (24) for locating the card member (14). In addition, the protrusion (28) aids in locating the card member (14). Once the card member (14) is in position the card member (14) is heat sealed to the card wall (26). Typically, the card member (14) has an adhesive that is activated for securing the card member (14) to the card wall (26).

In operation, the thermoformed blister package (10) is displayed using hanging, standing, cut case, and the like displays. In the application of hanging displays, the thermoformed blister packages (10) are position on a hook for consumer retrieval. The blister (12) is capable of nesting within one another typically permitting the hanging of larger number of articles. Nesting the blister (12) is generally achieved by sliding one of the thermoformed blister package (10) on the hook until the card member (14) contacts the product compartment (16) of another of the thermoformed blister package (10). The protrusion (28) of one of the thermoformed blister packages (10) is nested within the protrusion (28) of another one of the thermoformed blister package (10). In the application of standing displays, the thermoformed blister package (10) is placed on retailer's shelf. The protrusion (28) engages the shelf for standing the thermoformed blister package (10). Generally, applications have the flange (50) about the bottom wall (20) and the flange (50) inclines the thermoformed blister package (10) backwards allowing consumers to better visualize the articles being displayed. In the application of cut cases, the box the articles are shipped in is the basis for the display. Generally, the thermoformed blister packages (10) are nested and shipped to the retailer. The retailer then cuts the box to display the articles. Shipping the thermoformed blister packages (10) in nested configuration eliminates the usage of the insert tray and improves accessibility of the articles to the consumer.

Following is a method of heat sealing the blister (12) to the card member (14) having the card wall (26), the pair of side walls (24), the top wall (22), the protrusion (28), and the card member (14) for securing articles for display. Load the article or articles into the blister (12). Locate the card member (14) on the card wall (26) using the pair of side walls (24), the top wall (22), and the protrusion (28). Seal the card member (14) with the card wall (26). The card member (14) is secured to the card wall (26) by heating adhesive that is disposed on the card member (14).

Thermoformed blister packages (10) that utilize the blister (12) have reduced manufacturing cost, improved nestability and stability, as well as improved merchandising appeal. The ability to form blisters (12) that locates the card member (14) enhances the automation and efficiency of packaging machines. One is able to switch between two separate blister (12) designs with minimal configuration changes to the packaging machine. Producing blisters (12) with greater efficiency reduces the cost associated with producing thermoformed blister packages (10). Utilizing the blister (12) of the instant application benefits the retailer in that the retailer may display more thermoformed blister packages (10) in the same space constraints. In addition, having the flexibility to easily change from hanging displays to standings displays and vice versa provides optimal display options for the articles being sold. The blister (12) has more merchandising appeal to the consumer with three dimensional packaging that focuses on the article being sold. The protrusion (28) enhances the stability of the article and the perception of added value for the article. The use of the "try me" feature for display benefits from the use of the blister (12) of the instant application. The blister (12) is formed with the product compartment (16) extending through the bottom wall (20) and/or the bottom portion (38) simplifying the manufacturing process of the thermoformed blister package (10). In addition, the blister (12) generally has smooth edges where the product compartment (16) extends through the bottom wall (20) minimizes the need to soften cut edges as in typical "try me" displays.

Other aspects, objects and advantages of this invention can be obtained from a study of the drawings, the disclosure and the appended claims.

The invention claimed is:

1. A thermoformed blister for use with a card member, comprising:

a bottom wall defining a plane;

a top wall;

a pair of side walls each being defined by a bottom portion and a top portion, said pair of side walls define a flange plane;

a card wall defining a card plane, and said card plane generally intersecting said flange plane;

a protrusion being generally hollow and extending outwardly from said card wall; and a product compartment extending outwardly from said card wall and having a predetermined depth.

2. A thermoformed blister, as set forth in claim 1, wherein said card wall engaging said card member, and said card member being located by each top portion of said pair of side walls, said top wall, and said protrusion.

3. A thermoformed blister, as set forth in claim 1, wherein said card wall having at least one locating protrusion extending outwardly.

4. A thermoformed blister package, as set forth in claim 3, wherein said card wall engaging said card member, and said card member being located by at least one locating protrusions.

5. A thermoformed blister package, as set forth in claim 1, wherein said pair of side walls, said top wall, and said bottom wall having a flange.

6. A thermoformed blister package, as set forth in claim 5, wherein said flange having a predetermined flange width and said flange width being generally uniform in magnitude.

7. A thermoformed blister package, as set forth in claim 5, wherein said flange having a hanger portion and said hanger portion having an opening disposed there through.

8. A thermoformed blister package, as set forth in claim 1, wherein said bottom wall having a first predetermined width and said top wall having a second predetermined width, and said second predetermined width being generally less in magnitude than said first predetermined width.

9. A thermoformed blister package, as set forth in claim 8, wherein said first predetermined width being generally equal to said predetermined depth of said product compartment.

10. A thermoformed blister package, as set forth in claim 1, wherein said bottom portion having a first predetermined height measured from said plane of said bottom wall, said top portion having a second predetermined height measured from said top wall, and said second predetermined height being generally less in magnitude with said first predetermined height.

11. A thermoformed blister package, as set forth in claim 1, wherein said card plane being generally perpendicular with said bottom wall.

12. A thermoformed blister package, as set forth in claim 1, wherein said flange plane being generally inclined with said bottom wall.

13. A thermoformed blister package, as set forth in claim 1, wherein said protrusion having an outer wall and a second top wall, said outer wall being generally circular, and said top wall generally inclined with said bottom wall.

14. A thermoformed blister package, as set forth in claim 1, wherein said product compartment extending opposite from said protrusion.

15. A thermoformed blister package, as set forth in claim 1, wherein said product compartment extending through said bottom wall.

16. A thermoformed blister package, as set forth in claim 15, wherein said product compartment having an article disposed therein and said article extends through said bottom wall.

* * * * *